United States Patent [19]

Kristenson et al.

[11] 4,044,421

[45] Aug. 30, 1977

[54] COMBINATION DUST CONTAINER AND LATCHING MEANS FOR A VACUUM CLEANER

[75] Inventors: Kerstin Elisabeth Kristenson, Ronninge; Sven Bertil Simonsson, Tyresco, both of Sweden

[73] Assignee: Aktiebolaget Electrolux, Sweden

[21] Appl. No.: 649,691

[22] Filed: Jan. 16, 1976

[30] Foreign Application Priority Data

Jan. 20, 1975 Sweden ..... 7500558

[51] Int. Cl.[2] ..... A47L 9/14

[52] U.S. Cl. ..... 15/339; 55/373; 55/493; 55/DIG. 2

[58] Field of Search ..... 15/339, 347; 55/DIG. 2, 55/DIG. 3, 356, 373, 493, 214

[56] References Cited

U.S. PATENT DOCUMENTS

| | | | |
|---|---|---|---|
| 2,742,105 | 4/1956 | Dow | 55/373 X |
| 2,773,557 | 12/1956 | Engberg | 55/373 |
| 2,860,725 | 11/1958 | Cawl et al. | 55/373 X |

*Primary Examiner*—Christopher K. Moore
*Attorney, Agent, or Firm*—Alfred E. Miller

[57] ABSTRACT

A vacuum cleaner housing having a latching means for engagement with a portion of a disposable dust container when the latter is positioned within the vacuum cleaner so that the dust container is correctly latched. The correct latching indicates to the user that a dust container is present within the vacuum cleaner. The present arrangement is particularly suitable for tank-type cleaners in which the housing is opened and closed each time the full disposable dust container is removed.

7 Claims, 3 Drawing Figures

COMBINATION DUST CONTAINER AND LATCHING MEANS FOR A VACUUM CLEANER

BACKGROUND OF THE INVENTION

It often occurs that a full dust container or bag in a vacuum cleaner is removed and not replaced with a new empty bag. If this situation happens, and the vacuum cleaner is used without a bag, no dust separation will take place within the vacuum cleaner, but instead the air-borne dust is blown out of the vacuum cleaner and over the room being cleaned. Furthermore, some of the dust and dirt would find its way into the fan motor causing an interruption in operation. There are known constructions and arrangements which utilize different mechanical devices for sensing the existence or non-existence of a dust container in a vacuum cleaner housing, however, these devices are expensive to fabricate and require a considerable amount of space in the vacuum cleaner housing.

It is an object of the present invention to provide a simple arrangement in a vacuum cleaner which prevents the use of the vacuum cleaner without a dust container in the proper place.

It is a further object of the present invention to provide a combination vacuum cleaner closure means and a dust container in which the latter has a relatively stiff attachment plate that has a portion functioning as a gripping surface for the closure means.

It is another object of the present invention to provide a pivotable latching device on one part of a two-part vacuum cleaner housing, the latching means being adapted to engage the gripping surface of the attachment plate when the dust container is inserted in the other part of the vacuum cleaner housing.

In order that the invention will be more clearly understood, it will now be disclosed in greater detail with reference to the accompanying drawings, in which.

DESCRIPTION OF THE PREFERRED EMBODIMENT

Figure 1:
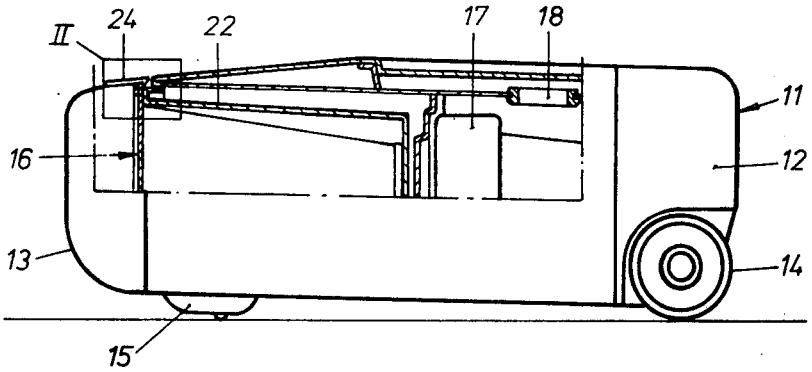
FIG. 1 is a side elevational view, partly in section, of a vacuum cleaner and a dust container constructed in accordance with the teachings of the present invention.
Figure 2:
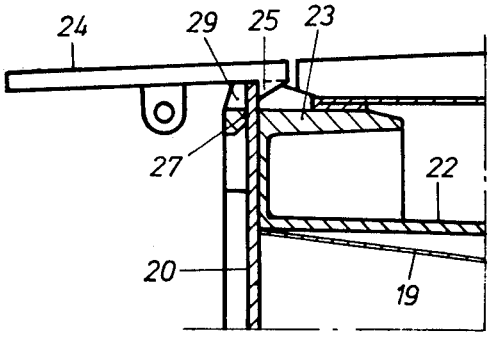
FIG. 2 is a sectional view, on an enlarged scale, of the latching means of the present invention, and identified as area II of FIG. 1.

Referring particularly to FIG. 1, the vacuum cleaner referred to generally by the reference numeral 11 includes a two-part casing having a housing portion 12 and a front cover portion 13. The housing 12 is provided with a pair of rear wheels 14 and a front, swivel-type castor wheel 15. The cover 13 is hinged to the front end of housing 12 by means of a pin (not shown) attached to its lower end whereby the cover 13 can be swung or pivoted to an open or closed position. The cover 13 has an air inlet A which is adapted to communicate with the dust container 16 that has been inserted in the housing. As is known, the purpose of the dust container or bag is to separate dirt, dust and other air-borne particles from the air flowing through it.

It should be apparent that the air flow through the housing is produced, in a known manner, by means of the motor fan unit 17 as seen in FIG. 1. The fan sucks in the air which flows through the dust container 16.

Thereafter, purified air is expelled out of the outlet opening 18.

The dust container 16 comprises an air pervious portion 19 connected to a front, rigid attachment plate 20 of cardboard or other suitable material having an air inlet opening 21. The peripheral portion of the plate 20 forms a supporting surface for the dust container when inserted in the housing. Furthermore, the dust container 16 rests in a perforated basket 22 enclosing the dust container and is supported therein by means of the plate held in the front collar 23 of the basket 22. A locking device is arranged on the cover portion 13 in the shape of a pivotable latching hook 24 which in its end facing the vacuum cleaner housing 12 has a gripping surface 25.

Figure 3:
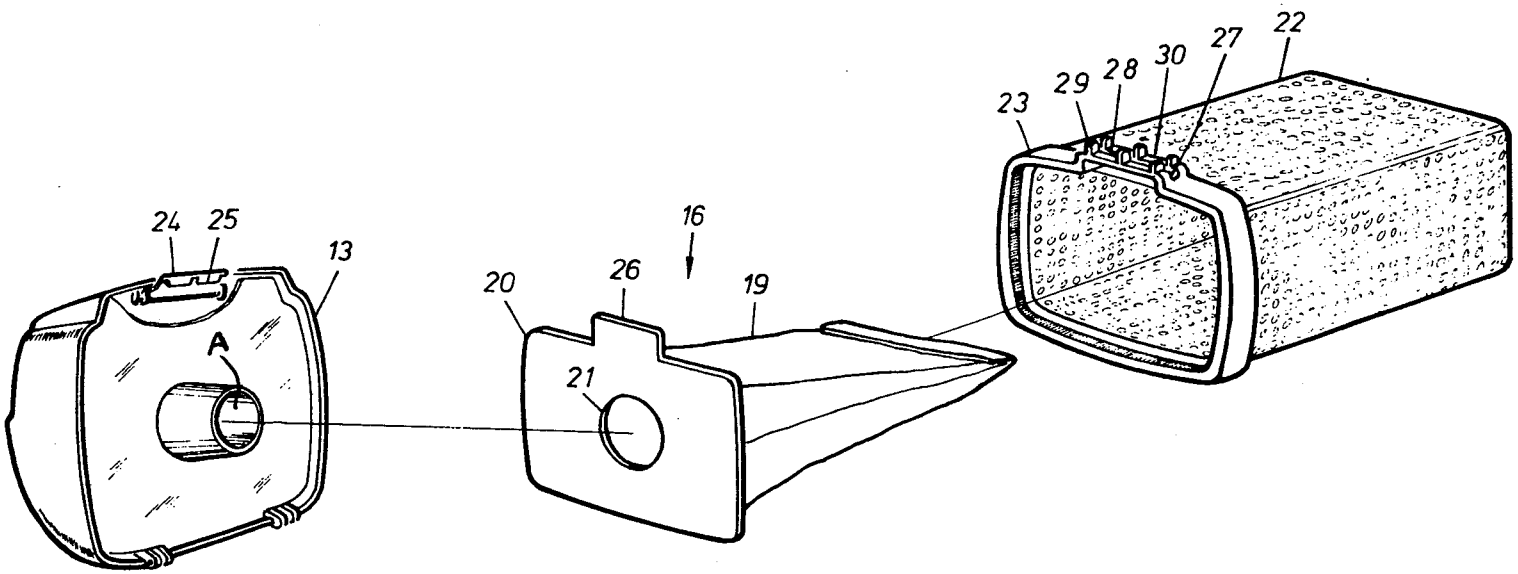
FIG. 3 is an exploded view of the components of the combination dust container, and latching means mounted on a part of the vacuum cleaner housing.

As seen in FIG. 3, a substantially rectangular flat lug 26 projects from the periphery of the attachment plate 20. This lug is arranged in the plane of the plate and forms, when the dust container 16 is inserted in the housing, functions as an intermediate filler panel for the gripping surface 25 of the latching hook 24.

A blocking surface 27 or keeper member is designed for co-action with the attachment plate 20 and is arranged on the collar 23 of the basket 22. The gripping surface 25 of the latching hook 24 and its center of rotation is so positioned as to be aligned with said keeper member 27 when the housing 12 and front cover 13 of the vacuum cleaner casing are assembled together. A slot 28 is formed by means of the collar 23 and the blocking surface 27 in which the lug 26 of the attachment plate 16 can be inserted.

The blocking surface or keeper member 27 consists of three upstanding projections 29 spatially arranged relative to each other, said projections forming two substantially U-shaped notches 30. The gripping surface 25 of the latching hook 24 has two claws separated from each other by a central notch, the width and height of each claw being are somewhat less than the corresponding dimensions of the notches 30.

In order to utilize the arrangement described hereinbefore the dust container 16 is placed in the basket 22 with the attachment plate 20 resting on the collar 23 and the lug 26 inserted in the slot 28 between the blocking surface 27 and the collar 23. The cover 13 is then swung or pivoted towards the housing 12, whereby the gripping surface 25 of the latching hook grasps the back side of the lug 26 and the cover is securely held in place. Thus, when no dust container is inserted in the housing, there is no grip surface for the gripping means of the latching hook and the cover cannot be latched. Accordingly, the lack of a dust container in the vacuum cleaner can be immediately detected.

The embodiment described and shown is only intended as an example. Thus, several modifications are conceivable within the scope of the invention. For example instead of being rectangular, the grip surface may be of any other suitable shape. The design of the blocking surface 27 and the gripping surface 25 can also be varied into several different configurations.

What is claimed is:

1. A combination dust container and a latching means for a vacuum cleaner comprising said dust container having an air pervious portion provided with an inlet opening for the reception of dust laden air and an attachment plate, said plate being of a relatively rigid material, a two-part vacuum cleaner housing, a latching hook and keeper member on said two-part housing whereby when said dust container is inserted in one part of said two-part housing with its attachment plate located between said two parts, a lug projecting from a peripheral surface of said attachment plate is provided with a portion that acts as an intermediate filler panel when said latching hook on one part of said two-part housing engages one side of said lug while the keeper member engages the opposite side thereof to retain said two-part housing in a closed position, said closed position indicating that the dust container is in place in said one part of said vacuum cleaner housing.

2. The combination as claimed in claim 1 wherein said lug is substantially rectangular in shape.

3. The combination as claimed in claim 2 wherein the height of said lug is approximately 3 mm.

4. The combination as claimed in claim 1 further comprising a perforated basket into which said dust container is inserted, a collar at the open end of said basket having said keeper member for said latching hook, said Keeper member having at least one slot for the reception of said lug projecting from the peripheral surface of the attachment plate of the dust container.

5. The combination as claimed in claim 4 wherein said keeper member has three spaced upstanding projections arranged on said collar, said projections together forming two substantially U-shaped notches.

6. The combination as claimed in claim 5 wherein the height of each projection is approximately 3 mm.

7. The combination as claimed in claim 5 wherein said latching hook is provided with a gripping surface including two claws that are spaced from each other by a notch, the width and height of each claw being less than the corresponding dimensions of the corresponding U-shaped notches to thereby pass therethrough in the absence of said lug.

* * * * *